US005709973A

United States Patent [19]

Chen et al.

[11] Patent Number: 5,709,973

[45] Date of Patent: Jan. 20, 1998

[54] PROCESS FOR CONTROLLING GLOSS IN ELECTROSTATIC IMAGES

[75] Inventors: Jiann Hsing Chen, Fairport; Lawrence Paul Demejo; Muhammed Aslam, both of Rochester, all of N.Y.

[73] Assignee: Eastman Kodak Company, Rochester, N.Y.

[21] Appl. No.: 673,448

[22] Filed: Jun. 28, 1996

[51] Int. Cl.[6] ..... G03G 13/01

[52] U.S. Cl. ..... 430/42; 430/99; 430/124; 349/333

[58] Field of Search ..... 430/99, 106, 42, 430/124; 427/45, 1; 399/278, 333

[56] References Cited

U.S. PATENT DOCUMENTS 4,957,774 9/1990 Doi et al. ..... 430/106.6
5,256,507 10/1993 Aslam et al. ..... 430/42

FOREIGN PATENT DOCUMENTS 63-300254 12/1988 Japan ..... G03G 15/01

*Primary Examiner*—John Goodrow
*Attorney, Agent, or Firm*—John R. Everett

[57] ABSTRACT

A process for controlling gloss to fused toner images, comprising the steps of:

A. passing an element bearing an unfused toner image through a fusing zone, a cooling zone and a release zone; and B. bringing the element bearing the unfused toner image into pressure contact with a fusing belt, thereby fusing the toner image to the element; characterized in that the fusing belt is a metal having (i) an unmatted powder coated tetrafluoroethylene/hexafluoropropylene (FEP) copolymer to provide a fused toner image having a coating gloss of 54–64;

(ii) an unmatted powder coated polytetrafluoroethylene-co-perfluoropropyl vinylether copolymer (PFA) to provide a fused toner image having a coating gloss of 11–18 and (iii) an unmatted aqueous spray coated blend of polytetrafluoroethylene (PTFE) and polytetrafluoroethylene-perfluorinated vinyl ether (PFA) to provide a fused toner image having a coating gloss of 5–12.

4 Claims, 1 Drawing Sheet

PROCESS FOR CONTROLLING GLOSS IN ELECTROSTATIC IMAGES

FIELD OF THE INVENTION

This invention relates to fusing electrostatographic toner images.

BACKGROUND OF THE INVENTION

In electrostatography an image comprising an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e., by imagewise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical foundation of an electrostatic field pattern on a surface of dielectric material). Typically, the electrostatic field pattern is developed into an electrostatographic toner pattern by contacting the field pattern with an electrostatographic developer containing an electrostatographic toner. If desired, the latent electrostatic field pattern can be transferred to another surface before such development. Although such techniques are typically used for black and white reproduction such as copying business correspondence, they are capable of forming a variety of single color or multi-color toner images.

A typical method of making a multicolor copy involves trichromatic color synthesis is subtractive color formation. In such synthesis successive latent electrostatic images are formed on a substrate, each representing a different color, and each image is developed with a toner of a different color and is transferred to a support (receiver). Typically, but not necessarily, the images will correspond to each of the three primary subtractive colors (cyan, magenta and yellow), and black as a fourth color, if desired. For example, light reflected from a color photograph to be copied can be passed through a filter before impinging on a charged photoconductive layer so that the latent electrostatic image on the photoconductive layer corresponds to the presence of yellow in the photograph. That latent image can be developed with a yellow toner and the developed image can be transferred to a support. Light reflected from the photograph can then be passed through another filter to form a latent electrostatic image on the photoconductive layer which corresponds to the presence of magenta in the photograph, and that latent image can then be developed with a magenta toner and transferred to the same support. The process can be repeated for cyan (and black, if desired).

It is known to use toner fusing processes to provide toner images having certain enhanced characteristics. For example, Japanese Patent Kokai No. 88/300,254, describes a process for preparing documents using direct digital printing and under color removal techniques to provide documents having full-color images in which a first portion, for example text, exhibits a low gloss or matte appearance and a second portion, for example a drawing, exhibits high gloss in relation to the first portion. This Japanese application indicates that such gloss differential presents a pleasing appearance to a viewer.

The process described in Japanese Application Number 88/300,254 involves (1) first forming on a support a toner image using a black toner having a loss tangent (tan δ) in the range of 1.30 to 1.60 at a storage elastic modulus (G') of $10^5$ dyne/cm$^2$, (2) forming on the same support a toner image using three primary subtractive color toners having a loss tangent (tan δ) in the range of 1.70 to 3.00 at a storage elastic modulus (G') of $10^5$ dyne/cm$^2$ and (3) fixing the images using a heated fuser roll. The Japanese application indicates that the aforementioned loss tangent ranges are critical to obtaining acceptable fused toner images having the required differential gloss and presents comparative data to illustrate this point.

The process described in Japanese Application No. 88/300,254 is adequate to provide gloss differential between toner images that form a fused toner pattern on a support. It is not, however, as flexible a process as would be desired to provide larger differences in gloss for a much greater variety of colored toners, as would be evidenced by lower loss tangents for black toners and higher loss tangents for subtractive color toners, as described in that application.

U.S. Pat. No. 5,411,779 discloses a composite tubular article for use as a fixing belt for fixing thermal images. The tublar article is comprises a tubular inner layer made of a polyamide resin and a tublar outer layer made of a fluoroplastic. The fluoroplastic layer has a surface roughness of 1 to 10 to provide a matte finish to fixed thermal images. Examples of the fluoroplastic include commercially available polytetrafluoroethylene resins (PTFE), tetrafluoroethylene/hexafluoropropylene copolymer resins (FEP), tetrafluoroethylene/perfluoroalkyl vinyl ether copolymer resins (PFA), and the like.

In light of the previous discussion, it is obvious that it would be desirable to have a fusing method capable of controlling gloss between a wide variety of toner images in an electrostatographic toner pattern.

SUMMARY OF THE INVENTION

Figure 1:
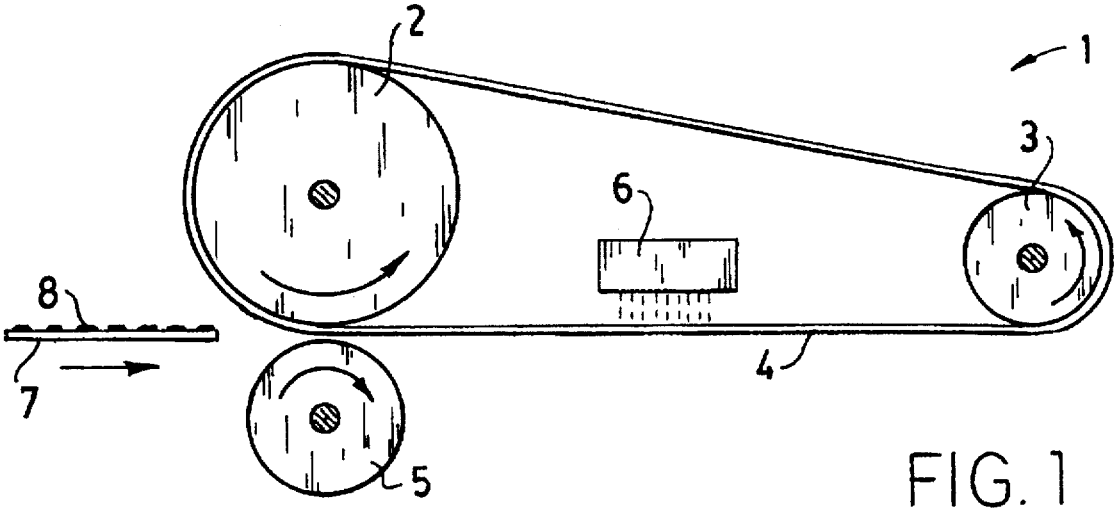
FIG. 1 is a schematic illustration of apparatus suitable for carrying out the method of this invention.

The present invention provides a process for controlling gloss to fused toner images, comprising the steps of:

A. passing an element bearing an unfused toner image through a fusing zone, a cooling zone and a release zone; and B. bringing the element bearing the unfused toner image into pressure contact with a fusing belt, thereby fusing the toner image to the element; characterized in that the fusing belt is a metal having (i) an unmatted powder coated tetrafluoroethylene/hexafluoropropylene (FEP) copolymer to provide a fused toner image having a coating gloss of 54–64;

(ii) an unmatted powder coated polytetrafluoroethylene-co-perfluoropropyl vinylether copolymer (PFA) to provide a fused toner image having a coating gloss of 11–18 and (iii) an unmatted aqueous spray coated blend of polytetrafluoroethylene (PTFE) and polytetrafluoroethylene-perfluorinated vinyl ether (PFA) to provide a fused toner image having a coating gloss of 5–12.

The invention also provides the fusing belt suitable for use in the process.

DETAILED DESCRIPTION OF THE INVENTION

The useful fluoropolymers defined above are available from E.I. DuPont.

The unfixed or unfused toner pattern that is fused in the method of the invention comprises toner images that can be generated using any electrostatographic image-forming process capable of providing toner images. Such patterns can comprise line copy, continuous tone images and half-tone images as well as combinations thereof. The toner images forming the pattern can be conveniently generated using electrostatographic processes of the type described previously, including four-color toner images prepared using digital four-color, full-color printers.

FIG. 1 illustrates a useful apparatus suitable for fusing or fixing an electrostatographic toner pattern to provide control gloss characteristics in the pattern according to the method of this invention. FIG. 1 depicts a fusing device 1 for providing fused toner images in a fused toner pattern which images exhibit a different level of gloss. Device 1 comprises a heating roll 2, a roll 3 spaced from the heating roll 2, a fusing member 4 which is trained about heating roll 2 and roll 3 as an endless or continuous metal web or belt 4 which is conveyed in a counterclockwise direction, as viewed in FIG. 1, upon rotation of the heating roll 2 and roll 3. Backup or pressure roll 5 is biased against the heating roll 2 and the continuous belt 4 is cooled by impinging air provided by blower 6. In operation, support 7 bearing the unfused toner pattern 8 is transported in the direction of the arrow into the nip between heating roll 2 and backup or pressure roll 5 which can be heated if desired, where it enters a fusing zone extending about 2.5 cm laterally along continuous belt 4. Following fusing in the fusing zone, the fused image pattern then continues along the path belt 4 and into the cooling zone about 5 to 25 cm in length in the region following the nip between heating roll 2 and pressure roll 3. Upon exiting the fusing zone belt 1 is cooled slightly upon separation from heating roll 3 and then additionally cooled in a controlled manner by air that is caused to impinge upon belt 4 by blower 6. The fused toner image pattern on support 7 then exits the cooling zone and separates from belt 4 as the belt passed around roll 3 and is transported to copy collection means such as a tray (not shown). Support 7 bearing the fused image pattern is separated from the fusing member within the release zone at a temperature where no toner image offset occurs. This separation is expedited by using a roll 3 of relatively small diameter e.g. a diameter of about 2.5 to 4 cm. As a result of passing through the three distinct zones, i.e. the fusing zone, cooling zone and release zone, the fused toner images in the fused image pattern exhibit different levels of gloss which are normally readily perceptible to the unaided eye. The extent of each of the three zones and the duration of time the toner pattern resides in each zone can be conveniently controlled simply by adjusting the velocity or speed of belt 4. The velocity of the belt is a specific situation will depend upon several variables, including, for example, the temperature of the belt I the fusing zone, the temperature of the cooling air and the composition of the toner particles.

Fusible toner particles used in this invention can have fusing temperatures of less than about 200° C., often less than 100° C. so they can readily be fused to papers sheets, even resin coated paper sheets without deformation (blistering) of the resin coating. Of course, if the toner images are fused to supports which can withstand higher temperatures, toner particles of higher fusing temperatures can be used.

Numerous colorant materials selected from dyestuffs or pigments can be employed in the toner particles used in the invention. Such materials serve to color the toner and/or render it more visible. Suitable toners can be prepared without the use of a colorant material where it is desired to have developed toner image of low optical densities and different Gloss levels. In those instances where it is desired to utilize a colorant, the colorants can, in principle, be selected from virtually any of the compounds mentioned in the Colour Index Volumes 1 and 2, Second Edition, Included among the vast number of useful colorants are those dyes and/or pigments that are typically employed as blue, green, red and yellow colorants used in electrostatographic toners to make color copies. Suitable colorants also include those typically employed in primary substrative cyan, magenta and yellow colored toners. Examples of useful colorants are Hansa Yellow G (C.I. 11680) C.I. Yellow 12, C.I. Solvent Yellow 16, C.I. Disperse Yellow 33, Nigrosine Spirit soluble (C.I. 50415), Chromogen Black ETOO (C.I. 45170), Solvent Black 3 (C.I. 26150), Fuchsine N (C.I. 42510) C.I. Pigment Red 22, C.I. Solvent Red 19, C.I. Basic Blue 9 (C.I. 52015) and Pigment Blue 15. Carbon black also provides a useful colorant. The amount of colorant added may vary over a wide range, for example, from about 1 to 20 percent of the weight of binder polymer used in the toner particles. Good results are obtained when the amount is from about 1 to 10 percent.

Charge control agents suitable for use in toners are disclosed for example in U.S. Pat. Nos. 3,893,935; 4,079,014; 4,323,634 and British Patent Nos. 1,501,065 and 1,420,839. Charge control agents are generally employed in small quantities such as, about 0.1 to 3 weight percent, often about 0.2 to 1.5 weight percent, based on the weight of toner.

Toner images fused according to this invention can be formed from electrostatographic developers comprising toner particles that are mixed with a carrier vehicle. Carrier vehicles which can be used to form suitable developer compositions, can be selected from a variety of materials. Such materials include carrier core particles and core particles overcoated with a thin layer of film-forming resin. Examples of suitable resins are described in U.S. Pat. Nos. 3,547,822; 3,632,512; 3,795,618; 3,898,170; 4,545,060; 4,478,925 4,076,857; and 3,970,571.

The carrier core particles can comprise conductive, non-conductive, magnetic, or non-magnetic materials. See, for example, U.S. Pat. Nos. 3,850,663 and 3,970,571. Especially useful in magnetic brush development schemes are iron particles such as porous iron. Particles having oxidized surfaces, steel particles, and other "hard" or "soft" ferromagnetic materials such as gamma ferric oxides or ferrites, such as ferrites of barium, strontium, lead, magnesium, or aluminum. See for example, U.S. Pat. Nos. 4,042,518; 4,478,925; and 4,546,060.

A typical developer composition containing toner particles and carrier vehicle generally comprises about 1 to 20 percent, by weight, of particulate toner particles and from 80 to 99 percent, by weight, carrier particles. Usually, the carrier particles are larger than the toner particles. Conventional carrier particles have a particle size on the order of about 20 to 1200 micrometers generally about 30 to 300 micrometers. Alternatively, the toners can be used in a single component developer, i.e., with no carrier particles.

The toner and developer compositions described in the previous paragraphs can be used in a variety of ways to develop electrostatic charge patterns to provide the electrostatographic toner patterns that can be fused by the method of this invention. Such developable charge patters can be prepared by a number of means can be carried for example, on a light sensitive photoconductive element or a non-light sensitive dielectric-surfaced element such as an insulatorcoated conductive sheet. One suitable development technique involves cascading the developer composition across the electrostatic charge pattern, while another technique involves applying toner particles from a magnetic brush. This latter technique involves the use of a magnetically attractable carrier vehicle in forming the developer composition. After image wise deposition of the toner particles to form an electrostatographic toner pattern, the pattern can be fixed or fused by the method of this invention to the support carrying the pattern. If desired, the unfused toner pattern can be transferred to a support such as a blank sheet of copy paper and then fused by the method of this invention to form a permanent image pattern.

Typical toner particles generally have an average particle size in the range of about 0.1 to 100 micrometers, a size of about 2 to 15 micrometers being particularly useful in the practice of this invention to form high resolution images.

In the method of this invention the toner image pattern is brought into pressure contact with the surface of the fusing member in the fusing zone, the temperature applied to fuse the toner particles causes the particles to fuse into a sintered mass which adheres to the support. Upon cooling in the cooling zone while in contact with the fusing member, the toner images achieve a gloss level dependent upon the fluoropolymer coating options provided by the invention. Typical temperatures used in the fusing zone are less than about 140° C., generally in the range of about 100° C. to 140° C., often 105° C. to 135° C. and preferably 115° C. to 130° C. The pressure used in this invention in combination with the aforementioned fusing temperature include those conventionally employed in contact fusing processes in the prior art. They are generally in the range of about 3 kg/cm$^2$ to 15 kg/cm$^2$ and often about 10 kg/cm$^2$. As indicated in FIGS. 1 and 2, such pressure is conveniently applied using a roll, although any suitable pressure means known to those skilled in the art could be used.

The fusing member of this invention is the continuous metal belt 4 indicated in FIG. 1. The surface of the fusing member is smooth. The continuous belt is reasonably flexible and also heat resistant; it is steel. The outer surface of the fusing member which contacts the toner images can comprise any aluminum or steel. Also release agents, for example, polymeric release oils such as polydiorganosiloxane release oils can be used. Belt 4 enters the fusing zone at a velocity of at least about 2.5 cm/sec., typically about 2.5 to 10 cm/sec. The velocity is generally kept constant as the element bearing the toner pattern moves through the cooling and release zones.

In the cooling zone, cooling of the fused toner pattern is controlled so that it can be released at a temperature where no toner image offset occurs. The temperature of the fused image pattern is Generally reduced at least about 40° C., often about 65° to 90° C. in the cooling zone. As previously indicated herein, controlling the velocity of the fusing member, for example, the velocity of a continuous belt. When a continuous belt is used as the fusing member, it usually is not necessary to press the element against the fusing member to maintain contact between the fusing member and the toner image pattern because the toner image pattern is heated in the fusing zone to a point where the fused pattern surface acts as an adhesive which temporarily bonds it to the fusing member as the fused toner pattern moves through the cooling zone.

In the release zone the fused toner pattern is separated from the fusing member. Such release is not effected until the fusing member is cooled to a temperature where no toner image offset occurs. Such temperature is typically no more than about 75° C. and is normally in the range of about 30° C. to 60° C. The specific temperature used to achieve such separation will vary considerably as it depends upon the flow properties of the toner particles. The release temperature chosen is such that the toner image exhibits a significant elastic characteristic and adheres to the support and exhibits sufficient cohesiveness such that it will not offset on the fuser member at the particular temperature used.

EXAMPLE

Three different fluoropolymer topcoats were coated over primed 3 μm thick stainless steel shims or belts (25" in circumference) using procedures described in literature available from the TEFLON Industrial Coating Systems Division of DuPont.

Each shim was primed with Dupont non blast polyamide/imide primer dispersion 855-021 (23.95% weight solids). The primer dispersion was filtered through a 150 mesh screen and then applied over each of the shims. The final dry film thickness was 7.5 μm. The shims had previously been solvent cleaned and dried using conventional air spray equipment.

Fluoroethylene-propylene (FEP) 532-8000 powder was screened through a 60 mesh screen and then coated over one of the primed shims using standard electrostatic powder coating equipment with charging voltages in the range of 40 to 60 Kv to a final dry film thickness of 25 μm.

A polytetrafluoroethylene-co-perfluoropropyl vinylether (PFA) 532-5011 topcoat was powder coated over a second primed shim using the same powder coating equipment and procedures. The curing conditions were 15 minutes at 700° F. (370° C.). The total coating thickness was 50 μm.

A blend of polytetrafluoroethylene and polytetrafluoroethylene-perfluorinated vinylether (PTFE/PFA) 855-500 dispersion (43.93% weight solids) was filtered through a 150 mesh screen and then spray coated over the third primed shim. The coating was air dried coating to a final dry thickness of 12.5 μm. The curing conditions were 10 minutes at 780° F. (415° C.) followed by 5 minutes at 800° F. (427° C.). The total coating thickness was 0.6 mils (15 μm).

The gloss levels were measured at a 20° angle using a Micro-TRI-gloss meter manufactured by BYK-Gardner in Silver Springs, MD. The method for measurement is described in ASTM-523.

The coating thickness and gloss of each coating are listed in the following table.

TABLE

| Coating | Thickness (microns) | G20 Coating Gloss |
|---|---|---|
| FEP | 25 | 54–64 |
| PFA | 50 | 11–18 |
| PTFE/PFA Blend | 12.5 | 5–12 |

The invention has been described in detail with particular reference to a preferred embodiment thereof. However it will be understood that variations and modifications can be effected within the spirit and scope of the invention as described hereinabove and defined in the appended claims.

What is claimed is:

1. A process for controlling gloss to fused toner images, comprising the steps of:

A. passing an element bearing an unfused toner image through a fusing zone, a cooling zone and a release zone; and B. bringing the element bearing the unfused toner image into pressure contact with a fusing belt, thereby fusing the toner image to the element; characterized in that the fusing belt is a metal having (i) an unmatted powder coated tetrafluoroethylene/hexafluoropropylene (FEP) copolymer to provide a fused toner image having a coating gloss of 54–64;

(ii) an unmatted powder coated polytetrafluoroethylene-co-perfluoropropyl vinylether copolymer (PFA) to provide a fused toner image having a coating gloss of 11–18 and (iii) an unmatted aqueous spray coated blend of polytetrafluoroethylene (PTFE) and polytetrafluoroethylene-perfluorinated vinyl ether (PFA) to provide a fused toner image having a coating gloss of 5–12.

2. The process of claim 1 wherein the toners in the unfused toner image have a release temperature of 40° C. to 65° C.

3. The process of claim 1 wherein the thickness of the fluoropolymer layer on the metal fuser belt is 7.5 to 50 μm.

4. A metal fuser belt having (i) an unmatted powder coated tetrafluoroethylene/hexafluoropropylene (FEP) copolymer to provide a fused toner image having a coating gloss of 54–64;

(ii) an unmatted powder coated polytetrafluoroethylene-co-perfluoropropyl vinylether copolymer (PFA) to provide a fused toner image having a coating gloss of 11–18 and (iii) an unmatted aqueous spray coated blend of polytetrafluoroethylene (PTFE) and polytetrafluoroethylene-perfluorinated vinyl ether (PFA) to provide a fused toner image having a coating gloss of 5–12.

* * * * *